US008326197B2

(12) United States Patent
Kim

(10) Patent No.: US 8,326,197 B2
(45) Date of Patent: Dec. 4, 2012

(54) FIXING UNIT AND IMAGE FORMING APPARATUS HAVING THE SAME

(75) Inventor: Han-kyoo Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 559 days.

(21) Appl. No.: 12/539,154

(22) Filed: Aug. 11, 2009

(65) Prior Publication Data

US 2010/0086333 A1 Apr. 8, 2010

(30) Foreign Application Priority Data

Oct. 8, 2008 (KR) ..... 10-2008-0098710

(51) Int. Cl.
*G03G 15/20* (2006.01)

(52) U.S. Cl. ..... 399/328; 399/320; 399/122

(58) Field of Classification Search ..... 399/358, 399/320, 122
See application file for complete search history.

(56) References Cited

U.S. PATENT DOCUMENTS

2004/0190958 A1* 9/2004 Matsumoto ..... 399/329
2007/0223977 A1* 9/2007 Matsubara et al. ..... 399/329
2007/0269230 A1* 11/2007 Hoshino et al. ..... 399/45

* cited by examiner

*Primary Examiner* — Walter L Lindsay, Jr.
*Assistant Examiner* — Roy Y Yi
(74) *Attorney, Agent, or Firm* — Staas & Halsey LLP

(57) ABSTRACT

Disclosed is a fixing unit of an image forming apparatus, the fixing unit including a first roller; a second roller which forms a nip together with the first roller; and a nip adjuster which is provided in at least one end part of the first roller and includes a restrictive ring formed with a plurality of cam profiles for regulating an axis distance between the first roller and the second roller to be varied to adjust a width of the nip.

21 Claims, 6 Drawing Sheets

FIXING UNIT AND IMAGE FORMING APPARATUS HAVING THE SAME

CROSS-REFERENCE TO RELATED APPLICATION

This application claims the benefit of Korean Patent Application No. 2008-98710, filed Oct. 8, 2008 in the Korean Intellectual Property Office, the disclosure of which is incorporated herein by reference.

BACKGROUND OF THE INVENTION

1. Field of the Invention

Apparatuses and methods consistent with aspects of the present invention relate to a fixing unit for fixing an image on a print medium and an image forming apparatus having the same, and more particularly, to a fixing unit capable of adjusting the width of a fixing nip according to characteristics of a printing job and an image forming apparatus having the same.

2. Description of the Related Art

An image forming apparatus uses a developer (such as ink or a toner) to form a visual image on a print medium. An electrophotography-type image forming apparatus forms an electrostatic latent image due to an electric potential difference on an image carrying body, applies a developer to the latent image to form a visual image, and transfers the visual image to a print medium. To fix the transferred visual image on the print medium, the image forming apparatus includes a fixing unit.

The fixing unit includes a heating roller and a pressing roller, and performs a fixing operation by heat and pressure while the print medium with the visual image passes through a fixing nip formed between both rollers. However, the fixing nip is required to have characteristics which vary depending on the kind of printing job. For example, if the print medium is plain paper, the fixing nip is required to have a relatively larger pressure than that for special paper, such as an envelope where plural sheets of paper are folded. Further, if the fixing nip with a pressure for the plain paper is used in the fix of the special paper, the print medium may be creased or the like.

To prevent this, there has been proposed a configuration to adjust the width of the fixing nip by adjusting the distance between the axes of the heating roller and the pressing roller through a manual lever in the case of a printing job for the special paper, thereby controlling the pressure applied on the print medium passing through the fixing nip. However, this configuration is inconvenient for a user since he/she has to first manipulate the lever according to the kind of print medium.

Also, there has been proposed a configuration to control the speed of the print medium transported via the fixing nip according to the kinds of print medium. However, this configuration is not suitable since the transport speed of the print medium has to be controlled during the printing job, and is also disadvantageous to high-speed printing.

SUMMARY OF THE INVENTION

Accordingly, an aspect of the present invention is to process a fixing unit, which has a simple structure for adjusting the width of a fixing nip formed between a heating roller and a pressing roller to control pressure applied onto a print medium in the fixing nip according to characteristics of a printing job, and an image forming apparatus.

The foregoing and/or other aspects of the present invention can be achieved by providing a fixing unit of an image forming apparatus, including: a first roller; a second roller which forms a nip together with the first roller; and a nip adjuster which is provided in at least one end part of the first roller and includes a restrictive ring formed with a plurality of cam profiles for regulating an axis distance between the first roller and the second roller to be varied to adjust a width of the nip.

According to an aspect of the present invention, the restrictive ring may be provided in a shaft of the first roller, and the cam profiles may be different in distance from the shaft of the first roller.

According to an aspect of the present invention, the nip adjuster may include a one-way power transmission unit interposed between the shaft of the first roller and the restrictive ring.

According to an aspect of the present invention, the one-way power transmission unit may include a one-way bearing which allows the restrictive ring to slip with respective to the shaft of the first roller when the first roller rotates in a forward direction, but to rotate along with the shaft of the first roller when the first roller rotates in a backward direction.

According to an aspect of the present invention, the fixing unit may further include a driving unit which rotates the first roller in forward and backward directions, wherein the driving unit drives the first roller to rotate in the forward direction when fixing the print medium, but to rotate as much as a predetermined angle in the backward direction to select one among the plurality of cam profiles for regulation when adjusting the width of the nip.

According to an aspect of the present invention, the driving unit may include a motor connected to and transmitting power to an end part of a shaft of the first roller and power transmission.

According to an aspect of the present invention, the nip adjuster may include an auxiliary restrictive ring provided in a shaft of the second roller and supported by the cam profile.

According to an aspect of the present invention, the auxiliary restrictive ring may have a constant distance between an area supported by the cam profile and the shaft of the second roller.

According to an aspect of the present invention, the nip adjuster may include a bearing interposed between the shaft of the second roller and the auxiliary restrictive ring and allowing the auxiliary restrictive ring to slip with respect to the shaft of the second roller.

According to an aspect of the present invention, the first roller may include a heating roller, and the second roller includes a pressing roller elastically pressing against the first roller.

Another aspect can be achieved by providing an image forming apparatus including: a medium feeding unit which supplies a print medium; an image forming unit which forms an image on the supplied print medium; and a fixing unit which fixes the image on the print medium, the fixing unit including: a first roller; a second roller which forms a nip together with the first roller; and a nip adjuster which is provided in at least one end part of the first roller and includes a restrictive ring formed with a plurality of cam profiles for regulating an axis distance between the first roller and the second roller to be varied to adjust a width of the nip.

Still another aspect of the present invention can be achieved by providing a fixing unit of an image forming apparatus, including: a first roller which has a driving shaft; a second roller which has a driven shaft passively rotated with regard to the driving shaft and forms a nip together with the first roller; and a nip adjuster which controls pressure applied to the nip, the nip adjuster including: a position-shift cam member which is provided in at least one end part of the driving shaft and formed with a plurality of cam profiles different in distance from the driving shaft; a circular cam member which is provided in the driving shaft corresponding to the position-shift cam member and supported by one of the plurality of cam profiles; and a one-way power transmission unit interposed between the position-shift cam member and the driving shaft.

According to an aspect of the present invention, the fixing unit may further include a motor for driving the driving shaft to rotate in forward and backward directions.

According to an aspect of the present invention, the motor may drive the driving shaft to rotate in the forward direction when fixing the print medium, and to rotate as much as a predetermined angle in the backward direction so that the circular cam member can be supported by one selected among the plurality of cam profiles when controlling the pressure applied to the nip.

According to an aspect of the present invention, the one-way power transmission unit may allow the position-shift cam member to slip with regard to the driving shaft when the motor drives in the forward direction, and to rotate along with the driving shaft when the motor drives in the backward direction.

According to an aspect of the present invention, the one-way power transmission unit may include a one-way bearing.

According to an aspect of the present invention, the nip adjuster may include a bearing interposed between the driven shaft and the circular cam member and allowing the circular cam member to slip with respect to the driven shaft.

According to an aspect of the present invention, the first roller may include a heating roller, and the second roller includes a pressing roller elastically pressing against the first roller.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings, in which.

DETAILED DESCRIPTION OF THE EMBODIMENTS

Figure 1:
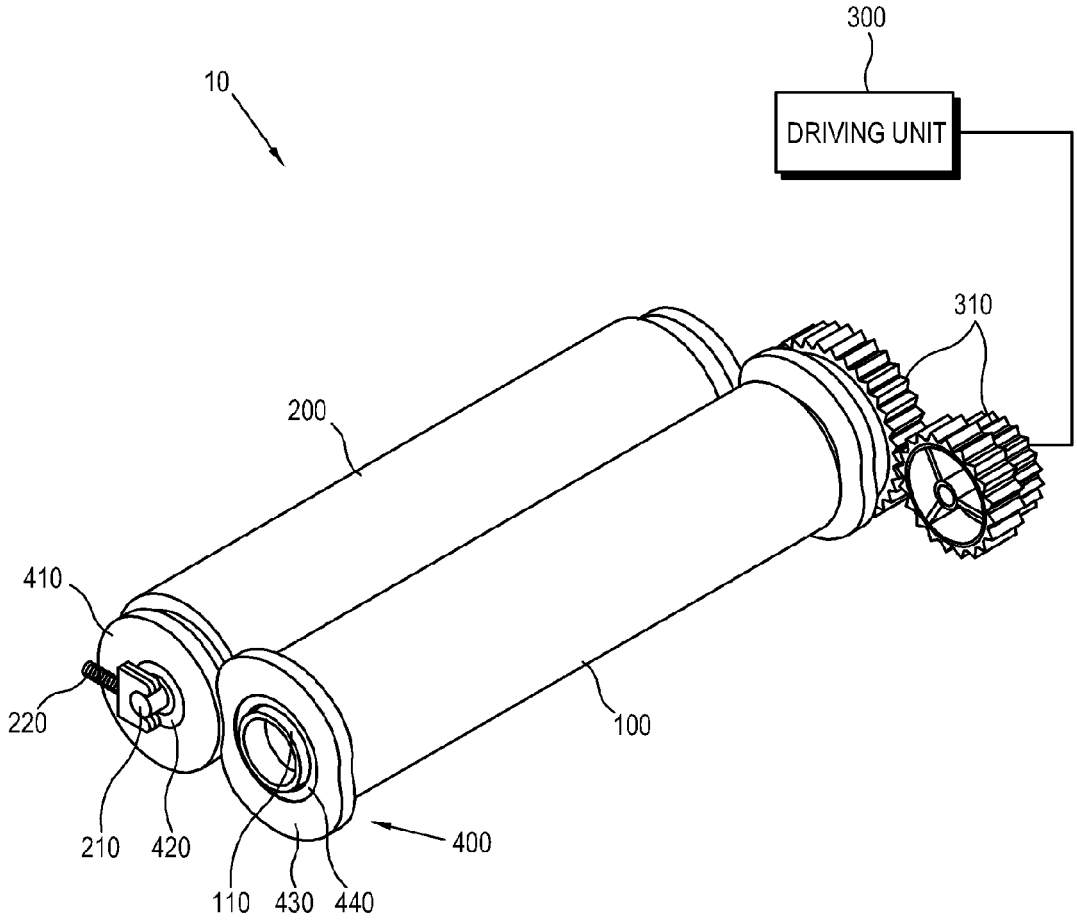
FIG. 1 is a perspective view of a fixing unit of an image forming apparatus according to an exemplary embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is a perspective view of a fixing unit 10 of an image forming apparatus according to an exemplary embodiment of the present invention. When a visual image is formed by a developer on a print medium during a printing job, the fixing unit 10 applies heat and pressure to the print medium passing through the fixing nip, thereby fixing the visual image on the print medium.

As shown in FIG. 1, the fixing unit according to the present embodiment includes a heating roller 100 which generates heat, and a pressing roller 200 which presses against the heating roller 100 to form a fixing nip with the heating roller 100. A driving unit driver 300 rotates the heating roller 100, and a fixing nip adjuster 400 adjusts the width of the fixing nip variously depending on change in characteristics of the printing job.

The heating roller 100 is provided with an internal heat source (not shown), so that its periphery can be heated up to a fixing temperature. The heating roller 100 is coupled to and rotates along with a heating roller shaft 110, and thus applies heat to the print medium with the visual image during a fixing process. The heating roller shaft 110 has one end engaged with a gear unit 310, so that it can be driven to rotate in forward and backward directions by the gear unit 310.

The pressing roller 200 is disposed in contact and parallel with the heating roller 100, and presses the print medium against the heating roller 100. Thus, the fixing nip is formed by contact in a longitudinal direction between the pressing roller 200 and the heating roller 100. The heat of the heating roller 100 and the pressure of the pressing roller 200 are applied to the fixing nip, so that the visual image is fixed as the print medium passes through the fixing nip.

The pressing roller 200 is coupled to a pressing roller shaft 210 and is rotatable. Both ends of the pressing roller shaft 210 are provided with an elastic biasing unit 220 to bias the pressing roller 200 and the pressing roller shaft 210 toward the heating roller 100. The shown elastic biasing unit 220 includes a coil spring and applies an elastic bias to the pressing roller shaft 210 in order to press the pressing roller 200 against the heating roller 100 and form the fixing nip. However, it is understood that other biasing devices can be used, such as those using elastic materials.

In this embodiment, the heating roller shaft 110 and the pressing roller shaft 210 serve as a driving shaft and a driven shaft, respectively, so that the pressing roller 200 is passively driven to rotate as the heating roller 100 rotates, but the invention is not limited thereto. However, in the present embodiment, the heating roller shaft 110 has to be used as the driving shaft since the pressing roller shaft 210 is movably provided together with the elastic biasing unit 220.

The driving unit 300 provides a driving power to the heating roller shaft 110 so that the heating roller shaft 110 can rotate. The driving unit 300 includes a motor (not shown) and a microprocessor (not shown) to control the motor, and drives the heating roller shaft 110 to selectively rotate forward or backward according to required processes. Here, the driving power is transmitted from the driving unit 300 to the heating roller shaft 110 via the gear unit 310 with a plurality of gears engaged with each other.

During a typical fixing process (i.e., while the print medium passes through the fixing nip), the driving unit 300 drives the heating roller shaft 110 to rotate in the forward direction. The driving unit 300 drives the heating roller shaft 110 to rotate as much as a predetermined angle in the backward direction when the width of the fixing nip is adjusted to control the pressure in the fixing nip. Here, the terms 'forward' and 'backward' are used for convenience in explaining opposing directions, but do not limit the rotational direction. Further, the predetermined angle is not limited to a specific angle, but can be any angle whereby the driving unit can drive the heating roller shaft 110 backward which results in the fixing nip adjuster 400 adjusts the nip.

While not required in all aspects, the driving unit 300 drives the fixing nip adjuster 400 to adjust the nip when the image forming apparatus determines that a change in the printing characteristics is required. By way of example, the image forming apparatus could detect a change in a required characteristics of the print job according to a selection of a user, such as by selecting an operation of printing an envelope using a printer drive, or through a user input directly into the image forming apparatus, such as through a key pad (not shown) or a lever (not shown). Alternately, such change could be detected through a sensor (not shown) detecting a size or thickness of the print medium passing into the image forming apparatus for a particular print job. However, the invention is not so limited.

The fixing nip adjuster 400 adjusts the pressure applied to the print medium passing through the fixing nip, if the required characteristics of the printing job are changed (e.g., if required fixing characteristics are changed according to different kinds of print medium for the fixing). To this end, the fixing nip adjuster 400 changes a distance between the axes of the heating roller 100 and the pressing roller 200, so that the fixing nip can be adjusted corresponding to the changed axis distance.

The fixing nip adjuster 400 includes an auxiliary restrictive ring 410 installed at an end part of the pressing roller shaft 210; a pressing roller bearing 420 interposed between the pressing roller shaft 210 and the auxiliary restrictive ring 410; a restrictive ring 430 installed at an end part of the heating roller shaft 110 and contacting the auxiliary restrictive ring 410; and a one-way power transmission unit 440 interposed between the heating roller shaft 110 and the restrictive ring 430.

As shown, the one-way power transmission unit 440 may be achieved by the one-way bearing 440, but is not limited thereto. Hereinafter, the one-way bearing 440 will be described as an exemplary embodiment of the one-way power transmission unit 440. Also, the terms 'auxiliary restrictive ring' and 'restrictive ring' do not limit the spirit of the present invention. For example, the auxiliary restrictive ring and the restrictive ring may be a circular cam member 410 and a position-shift cam member 430, respectively.

Figure 2:
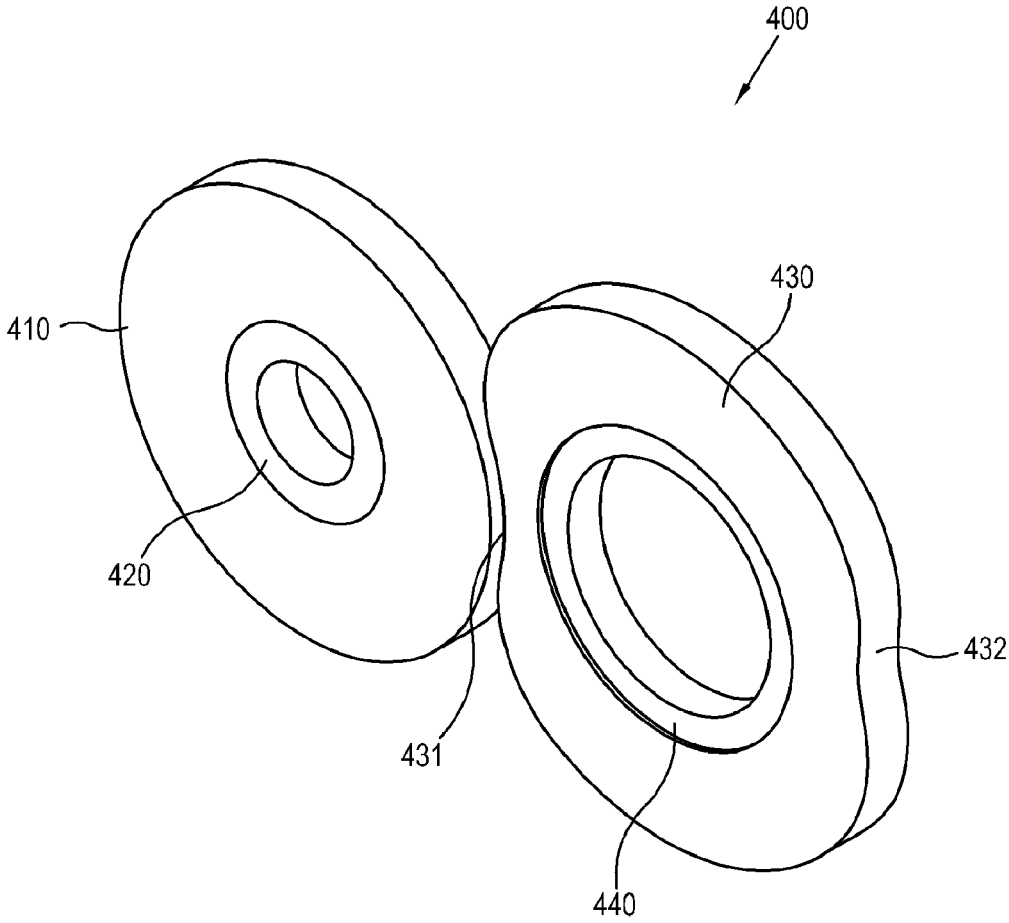
FIG. 2 is a partial perspective view of a fixing nip adjuster in the fixing unit of FIG. 1.

Below, the fixing nip adjuster 400 will be described with reference to FIG. 2. FIG. 2 is a partial perspective view of the fixing nip adjuster 400 in the fixing unit 10 of FIG. 1. The auxiliary restrictive ring 410 is shaped like a disc formed with a hole at the center. The central hole of the auxiliary restrictive ring 410 allows the pressing roller shaft 210 to pass therethrough. The radial periphery of the auxiliary restrictive ring 410 is in contact with and supported by the periphery of the restrictive ring 430, so that the distance between the axes of the heating roller 100 and the pressing roller 200 can be maintained.

The auxiliary restrictive ring 410 is shaped like a ring where a distance between one side contacting the restrictive ring 430 and the pressing roller shaft 210 is constant, but its shape is not limited to the ring. Thus, the distance between the axes of the heating roller 100 and the pressing roller 200 is adjusted by the restrictive ring 430, so that the fixing nip adjuster 400 can be easily designed and the adjusted distance can be maintained even though the restrictive ring 410 rotates after the distance is adjusted by the restrictive ring 430.

The pressing roller bearing 420 is interposed between the auxiliary restrictive ring 410 and the pressing roller shaft 210. Thus, the pressing roller bearing 420 slips without rotating along with the pressing roller shaft 210 while the pressing roller shaft 210 rotates. Due to rotation of the pressing roller bearing 420, a contact area between the auxiliary restrictive ring 410 and the restrictive ring 430 is prevented from being frictionally worn away.

The restrictive ring 430 is installed at the end part of the heating roller shaft 110 and is in contact with the auxiliary restrictive ring 410. The restrictive ring 430 is shaped like a disc on a plane parallel with a radial direction of the heating roller shaft 110, and formed with a central hole through which the heating roller shaft 110 passes.

The restrictive ring 430 is formed with a plurality of cam profiles 431 and 432 on the periphery thereof. The cam profiles 431 and 432 selectively contact the radial periphery of the pressing roller shaft 210 (i.e., the auxiliary restrictive ring 410). In this embodiment, a first profile 431 and a second profile 432 are formed, but this does not limit the spirit of the present invention. Alternatively, the number of cam profiles formed in the restrictive ring 430 may increase according to variation in adjusting the width of the fixing nip.

The cam profiles 431 and 432 regulate the distance between the axes of the heating roller 100 and the pressing roller 200 by supporting the auxiliary restrictive ring 410. The pressing roller 200 is elastically biased toward the heating roller 100 by the elastic biasing unit 220, in which either of the cam profile 431 or 432 supports the restrictive ring 410 so that the pressing roller 200 can be regulated not to be closer than a predetermined distance to the heating roller 100.

The cam profiles 431 and 432 are recessed corresponding to the shape of the auxiliary restrictive ring 410 so as to stably support the disc-shaped auxiliary restrictive ring 410. Thus, the cam profiles 431 and 432 are prevented from being separated away from their original positions when the restrictive ring 430 slips with respect to the heating roller shaft 110 rotating during the fixing process. Here, the shapes of the cam profiles 431 and 432 may vary variously according to their purposes.

In this embodiment, the cam profiles 431 and 432 include the first profile 431 and the second profile 432. The first profile 431 and the second profile 432 are different in distance from the heating roller shaft 110. Thus, the distance between the axes of the heating roller 100 and the pressing roller 200 is varied according to whether the auxiliary restrictive ring 410 is supported by the first profile 431 or the second profile 432. Accordingly, the width of the fixing nip is varied to thereby control the pressure applied to the print medium passing through the fixing nip.

The one-way bearing 440 is interposed between the heating roller shaft 110 and the restrictive ring 430. The one-way bearing 440 allows the restrictive ring 430 to slip with respect to the heating roller shaft 110 when the heating roller shaft 110 rotates in the forward direction. That is, the restrictive ring 430 does not rotate along with the heating roller shaft 110 when the heating roller shaft 110 rotates in the forward direction. On the other hand, the one-way bearing 440 allows the restrictive ring 430 to rotate along with the heating roller shaft 110 when the heating roller shaft 110 rotates in the backward direction.

During the fixing process of the printing job (i.e., while the print medium passes through the fixing nip), the heating roller shaft 110 rotates in the forward direction. At this time, the restrictive ring 430 does not rotate by the one-way bearing 440, and the cam profiles 431 and 432 maintain support for the auxiliary restrictive ring 410. Thus, the distance between the axes of the heating roller 100 and the pressing roller 200 is maintained while the print medium passes through the fixing nip.

However, when the width of the fixing nip is adjusted, one of the cam profiles 431 and 432 which regulates the auxiliary restrictive ring 410 at that time has to be selectively altered to the other one of the profiles 431,432. Thus, the heating roller shaft 110 rotates in the backward direction, and the restrictive ring 430 rotates along with the heating roller shaft 110 by the one-way bearing 440. When the restrictive ring 430 rotates to a position where the selected cam profile 431, 432 regulates the auxiliary restrictive ring 410, the heating roller shaft 110 stops rotating. Therefore, the distance between the axes of the heating roller 100 and the pressing roller 200 is changed to thereby adjust the width of the fixing nip.

With this configuration, a process of adjusting the width of the fixing nip in the fixing unit 10 according to the present embodiment will be described with reference to FIGS. 3 and 4. At an initial state, the auxiliary restrictive ring 410 is regulated by the first profile 431.

Figure 3:
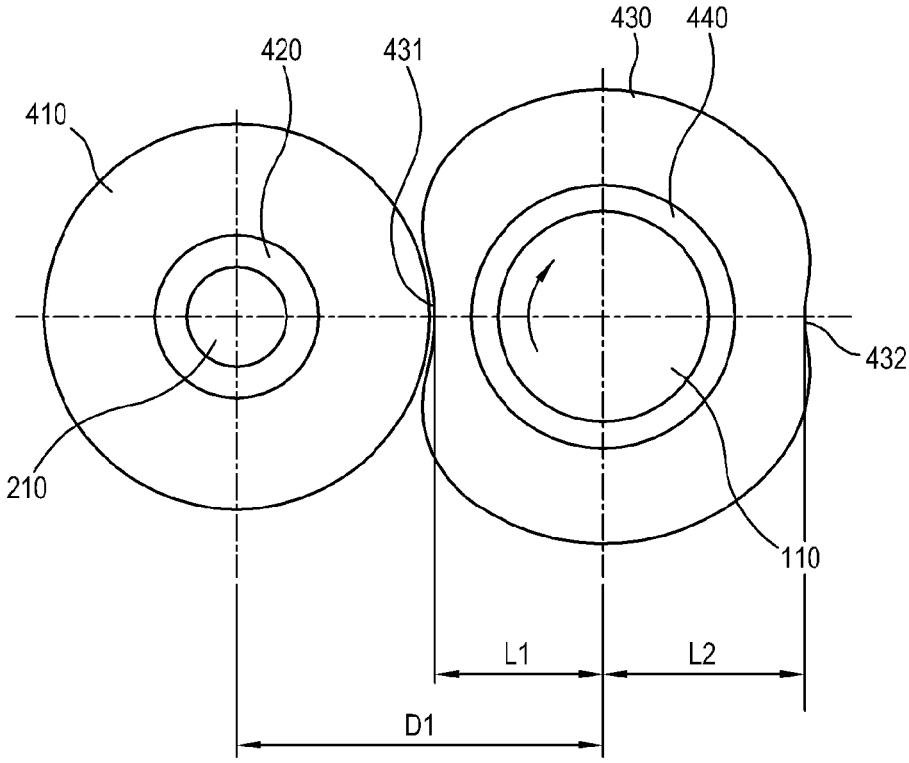
FIG. 3 is a lateral cross-section view illustrating that distance between axes of a heating roller and a pressing roller is adjusted by a first profile in the fixing nip adjuster of FIG. 2.

FIG. 3 is a lateral cross-section view illustrating that the auxiliary restrictive ring 410 is regulated by the first profile 431 in the fixing nip adjuster 400 of FIG. 2. Here, various methods may be used for determining the initial state. For example, a separate sensor (not shown) may sense which one of the plural cam profiles 431 and 432 regulates the auxiliary restrictive ring 410. Further, a separate processor (not shown) may be provided for controlling operations of the fixing unit 10.

As shown in FIG. 3, the auxiliary restrictive ring 410 is regulated by the first profile 431. In this state, the heating roller shaft 110 rotates to fix the print medium in the forward direction (i.e., clockwise in FIG. 3). However, the restrictive ring 430 slips without rotating because of the one-way bearing 440, and thus the first profile 321 maintains its original position even though the heating roller shaft 110 continues to rotate. Therefore, the distance between the axes of the heating roller 100 and the pressing roller 200 is maintained at D1 when the first profile 431 is used.

From this state, if the width of the fixing nip has to be adjusted, the second profile 432 is selected to regulate the auxiliary restrictive ring 410. Referring to FIG. 3, a distance L1 from the center of the heating roller shaft 110 to the first profile 431 is shorter than a distance L2 from the center of the heating roller shaft 110 to the second profile 432. Thus, when the second profile 432 regulates the auxiliary restrictive ring 410, the distance between the axes of the heating roller 100 and the pressing roller 200 becomes larger than D1 (i.e., D2 is FIG. 4).

To this end, the heating roller shaft 110 rotates in the backward direction (i.e., counterclockwise in FIG. 3). At this time, the one-way bearing 440 makes the restrictive ring 430 rotate along with the heating roller shaft 110 as much as a predetermined angle in the backward direction to a position where the second profile 432 regulates the auxiliary restrictive ring 410 as shown in FIG. 4.

Figure 4:
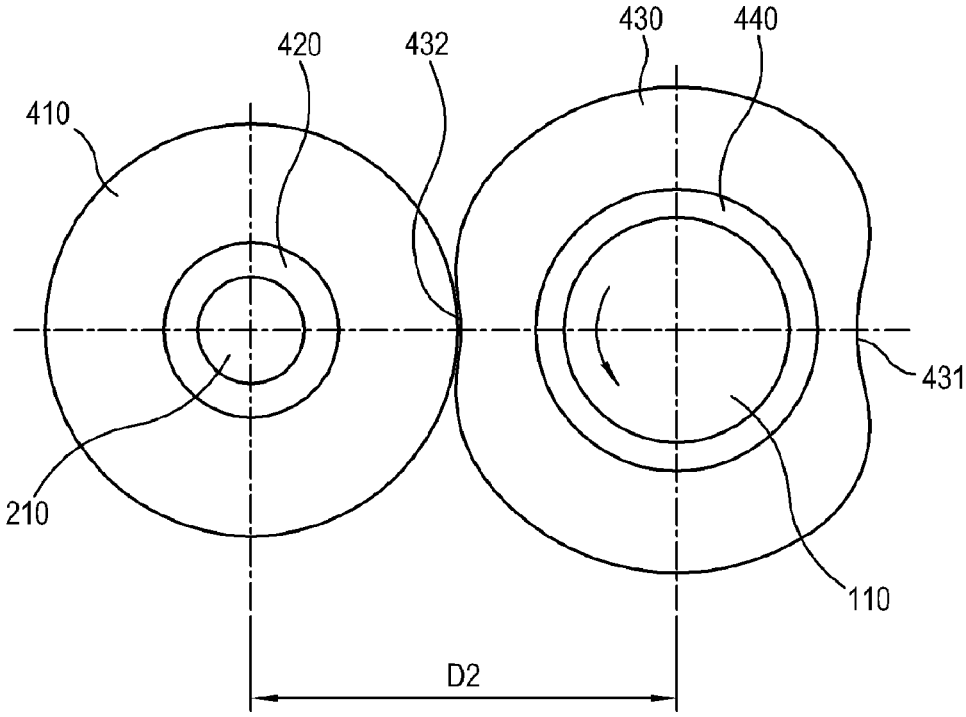
FIG. 4 is a lateral cross-section view illustrating that the distance between the axes of the heating roller and the pressing roller is adjusted by a second profile in the fixing nip adjuster of FIG. 2.

FIG. 4 is a lateral cross-section view illustrating that the second profile 432 is selected to regulate the auxiliary restrictive ring 410 in the fixing nip adjuster of FIG. 3. As shown in FIG. 4, the auxiliary restrictive ring 410 is regulated by the second profile 432. In this state, the heating roller shaft 110 stops rotating in the backward direction.

In this case, since L2>L1, the distance D2 between the axes of the heating roller 100 and the pressing roller 200 increases as much as (L2−L1). That is, D2=D1+(L2−L1). As the distance between the axes of the heating roller 100 and the pressing roller 200 is changed, the width of the fixing nip is adjusted.

Figure 5:
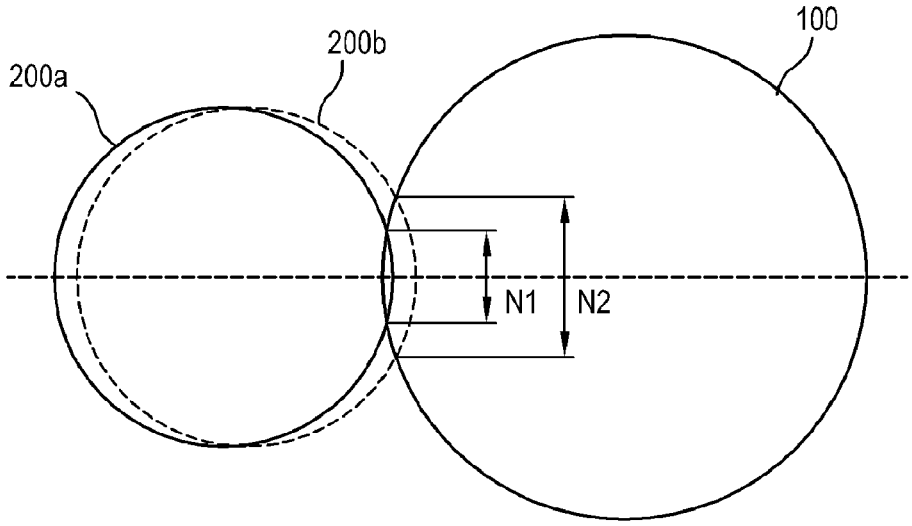
FIG. 5 is a lateral cross-section view illustrating comparison between the widths of the fixing nip corresponding to the cases of FIGS. 3 and 4, respectively.

FIG. 5 is a lateral cross-section view illustrating variation between the widths of the fixing nip corresponding to the cases of FIGS. 3 and 4, respectively. In FIG. 5, a reference numeral of 200*a* shows the position of the pressing roller 200 when the auxiliary restrictive ring 410 is regulated by the second profile 432 (refer to FIG. 4), and a reference numeral of 200*b* shows the position of the pressing roller 200 when the auxiliary restrictive ring 410 is regulated by the first profile 431 (refer to FIG. 3).

In the case of using the first profile 431 in the regulation, the width of the fixing nip formed by contact between the pressing roller 200*b* and the heating roller 100 is N2. On the other hand, in the case of using the second profile 432 in the regulation, the width of the fixing nip formed by contact between the pressing roller 200*a* and the heating roller 100 is N1.

As the axis distance between the heating roller 100 and the pressing roller 200 increases from D1 to D2, the width of the fixing nip decreases from N2 to N1. Thus, under the condition that the print medium moves at the same speed, the decreased width of the fixing nip results in reducing the fixing pressure applied to the print medium during the fixing process.

In other words, the fixing pressure applied to the print medium during the fixing process is in proportion to the width of the fixing nip, but in inverse proportion to the distance between the axes of the heating roller 100 and the pressing roller 200. Consequently, with the foregoing configuration, it is possible to adjust the fixing pressure applied to the print medium.

Meanwhile, the restrictive ring 430 in this embodiment includes two cam profiles 431 and 432, but the invention is not limited thereto. Alternatively, if there is needed to adjust the width of the fixing nip by a plurality of steps, the restrictive ring 430 may be formed with a plurality of cam profiles corresponding to the plurality of steps so as to allow multiple nip width adjustment.

Also, the foregoing embodiment discloses a configuration for adjusting the width of the fixing nip in the fixing unit 10, but the spirit of the present invention is not limited to this embodiment. Alternatively, the present invention may be applied to a roller unit that includes two rollers forming a nip so as to adjust the width of the fixing nip. Such a roller unit can be in an image forming apparatus, or in other devices which move multiple types of media.

Further, the foregoing embodiment discloses that the restrictive ring 430 is installed in the heating roller shaft 110, but the invention is not limited thereto. Alternatively, the restrictive ring 430 may be installed in the pressing roller shaft 210, and the auxiliary restrictive ring 410 may be installed in the heating roller shaft 110. In this case, the one-way bearing 440 is also installed in the pressing roller shaft 210 in order to selectively rotate the restrictive ring 430.

Figure 6:
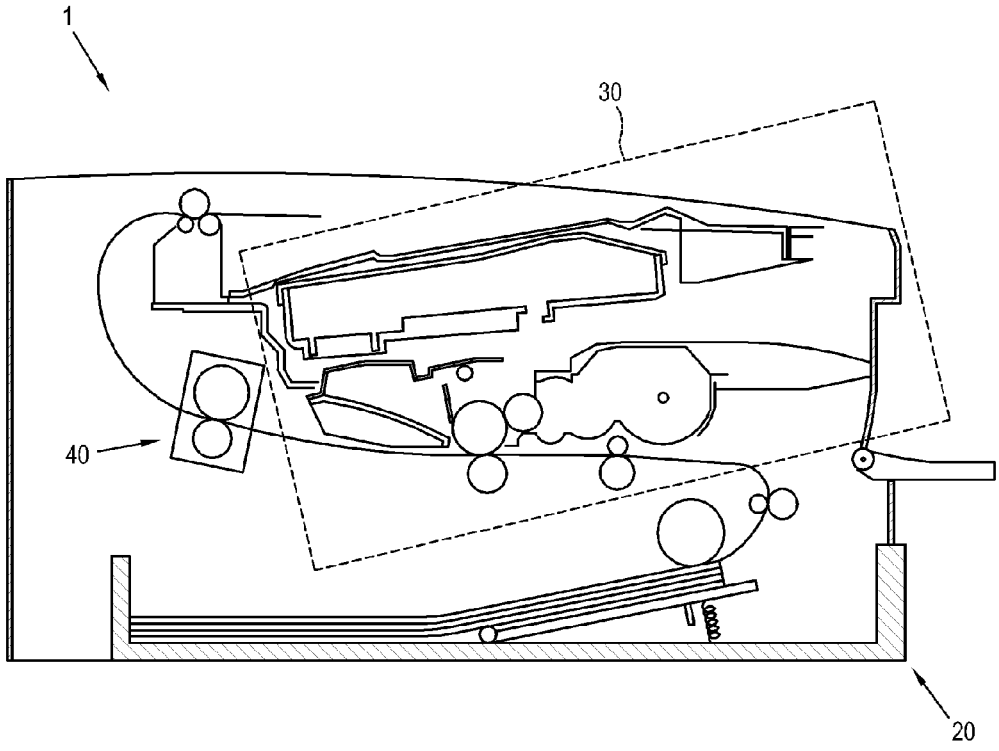
FIG. 6 is a lateral cross-section view of the image forming apparatus according to an exemplary embodiment of the present invention.

FIG. 6 is a lateral cross-section view of the image forming apparatus 1 according to an exemplary embodiment of the present invention. As shown in FIG. 6, the image forming apparatus 1 includes a medium feeding unit 20 in which the print medium is stacked and from which the print medium is supplied; an image forming unit 30 which forms a visual image based on a developer and transfers it on the print medium supplied from the medium feeding unit 20; and a fixing unit 40 which fixes the transferred visual image on the print medium. While not required, the apparatus 1 can include a scanning, faxing and/or copying function, as in the case of a multi-function machine. Further, the apparatus 1 includes a controller (not shown) which controls the elements of the apparatus 1 to perform print jobs, and thus drives the driving unit 300 and the fixing nip adjuster 400 to adjust the nip. While not required in all aspects, the controller can be implemented using one or more computers and/or processors executing software and/or firmware encoded on one or more computer readable media.

In this embodiment, the image forming unit 30 uses a mono developer to form an image with black and white tones, but not limited thereto. Alternatively, the spirit of the present invention may be applied when using a plurality of developers to form a color image.

The fixing unit 40 applies heat and pressure to the print medium on which the visual image is transferred by the image forming unit 30, thereby fixing the visual image. The fixing unit 40 has substantially the same configurations as the fixing unit 10 according to the foregoing embodiment as described above, and thus detailed descriptions thereof will be omitted.

As is apparent from the foregoing exemplary embodiments of the present invention, a restrictive ring regulates a distance between axes of a heating roller and a pressing roller to adjust the width of a fixing nip, so that pressure applied to a print medium in the fixing nip can be controlled by a simple structure in correspondence to change in characteristics of a printing job (e.g., according to the kinds of print medium).

According to aspects of the invention, a plurality of cam profiles different in distance from a rotational shaft is formed in the restrictive ring, so that the distance between the axes of the heating roller and the pressing roller can be variously regulated by a simple structure.

Also, according to aspects of the invention, a one-way bearing is placed between the restrictive ring and the rotational shaft, so that the restrictive ring can be either slipped or rotated along with the rotational shaft according to rotating directions of the rotational shaft, thereby distinguishing between a general fixing process of a fixing unit and a width adjusting process of a fixing nip and selectively performing either of the fixing process or the width adjusting process.

Further, according to aspects of the invention and in contrast to a conventional fixing unit, there is no need of varying a driving speed of the fixing unit so as to lower the speed of the print medium passing through the fixing nip according to the kinds of print medium during the printing job. Accordingly, there is provided an image forming apparatus capable of high-speed printing.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A fixing unit of an image forming apparatus, comprising:

a first roller having a first axis;

a second roller which forms a nip together with the first roller and which has a second axis; and a nip adjuster which is provided at an end part of the first roller and comprises a restrictive ring formed with a plurality of cam profiles for varying an axis distance between the first and second axes to adjust a width of the nip;

wherein the nip adjuster comprises an auxiliary restrictive ring provided at a shaft of the second roller and supported by the cam profile allowing the auxiliary restrictive ring to interact with the restrictive ring.

2. The fixing unit according to claim 1, wherein the restrictive ring is provided at a shaft of the first roller, and the cam profiles are different each other in distance from the shaft of the first roller.

3. The fixing unit according to claim 2, wherein the nip adjuster comprises a one-way power transmission unit interposed between the shaft of the first roller and the restrictive ring.

4. The fixing unit according to claim 3, wherein the one-way power transmission unit comprises a one-way bearing which allows the restrictive ring to slip with respective to the shaft of the first roller when the first roller rotates in a first direction, but to rotate along with the shaft of the first roller when the first roller rotates in a second direction other than the first direction.

5. The fixing unit according to claim 1, further comprising a driving unit which rotates the first roller in first and second directions, wherein the driving unit drives the first roller to rotate in the first direction when fixing the print medium, and to rotate up to a predetermined angle in the second direction to select one among the plurality of cam profiles when adjusting the width of the nip.

6. The fixing unit according to claim 5, wherein the driving unit comprises a motor connected to and transmitting power to an end part of a shaft of the first roller.

7. The fixing unit according to claim 1, wherein the auxiliary restrictive ring has a constant distance between an area supported by the cam profile and the shaft of the second roller.

8. The fixing unit according to claim 1, wherein the nip adjuster comprises a bearing interposed between the shaft of the second roller and the auxiliary restrictive ring and allowing the auxiliary restrictive ring to slip with respect to the shaft of the second roller.

9. The fixing unit according to claim 1, wherein the first roller comprises a heating roller, and the second roller comprises a pressing roller elastically pressing against the first roller.

10. A fixing unit of an image forming apparatus, comprising:

a first roller which has a driving shaft having a first axis;

a second roller which has a driven shaft passively rotated with regard to the driving shaft and forms a nip together with the first roller and which has a second axis other than the first axis; and a nip adjuster which controls pressure applied to the nip, the nip adjuster comprising:

a position-shift cam member which is provided at an end part of the driving shaft and formed with a plurality of cam profiles different in distance from the driving shaft;

a circular cam member which is provided at the driven shaft corresponding to the position-shift cam member and supported by one of the plurality of cam profiles; and a one-way power transmission unit interposed between the position-shift cam member and the driving shaft;

wherein the nip adjuster comprises an auxiliary restrictive ring provided at a shaft of the second roller and supported by the cam profile allowing the auxiliary restrictive ring to interact with the restrictive ring.

11. The fixing unit according to claim 10, further comprising a motor for driving the driving shaft to rotate in first and second directions.

12. The fixing unit according to claim 11, wherein the motor drives the driving shaft to rotate in the first direction when fixing the print medium, and to rotate up to a predetermined angle in the second direction so that the circular cam member is supported by a selected other one of the plurality of cam profiles when controlling the pressure applied to the nip.

13. The fixing unit according to claim 11, wherein the one-way power transmission unit allows the position-shift cam member to slip with regard to the driving shaft when the motor drives in the first direction, and to rotate along with the driving shaft when the motor drives in the second direction.

14. The fixing unit according to claim 13, wherein the one-way power transmission unit comprises a one-way bearing.

15. The fixing unit according to claim 10, wherein the nip adjuster comprises a bearing interposed between the driven shaft and the circular cam member and allowing the circular cam member to slip with respect to the driven shaft.

16. The fixing unit according to claim 10, wherein the first roller comprises a heating roller, and the second roller comprises a pressing roller elastically pressing against the first roller.

17. A fixing unit of an image forming apparatus, comprising:

a first roller having a first axis;

a second roller which forms a nip together with the first roller and which has a second axis; and a nip adjuster which comprises a restrictive ring formed provided at the shaft of the second roller with at least first and second cam profiles which selectively adjust the nip according to a rotation direction of one of the first and second rollers, wherein the first cam profile adjusts the first and second rollers to form a first nip width, and the second cam profile adjusts the first and second rollers to form a second nip width other than the first nip width;

wherein the nip adjuster comprises an auxiliary restrictive ring provided at a shaft of the first roller and supported by the cam profile allowing the auxiliary restrictive ring to interact with the restrictive ring.

18. The fixing unit of claim 17, wherein the restrictive ring selectively engages the first roller such that, when the first roller rotates in a first direction, the restrictive ring does not rotate, and when the first roller rotates in a second direction other than the first direction, the restrictive ring rotates to switch between the first and second cam profiles to exchange between the first and second nip widths.

19. The fixing unit of claim 18, further comprising a driving unit which drives the first roller to rotate the first direction to move a printing medium using the nip, and drives the first roller in the second direction to engage the restrictive ring to exchange the first and second cam profiles.

20. The fixing unit of claim 17, wherein the nip adjuster further comprises a one way bearing disposed between a shaft of the first roller and the restrictive ring, the one way bearing allowing the shaft to rotate relative to the restrictive ring when the first roller rotates in the first direction to move a printing medium using the nip, and engages the shaft and the restrictive ring such that the restrictive ring rotates with the shaft in the second direction to exchange between the first and second cam profiles.

21. The fixing unit of claim 17, wherein the nip adjuster further comprises an auxiliary restrictive ring provided at a shaft of the first roller and which is biased against the restrictive ring at a selected one of the first and second cam profiles, wherein a change between the first and second profiles causes the auxiliary ring to move the shaft of the first roller relative to a shaft of the second roller.

* * * * *